US007275588B2

(12) United States Patent
Hsu

(10) Patent No.: US 7,275,588 B2
(45) Date of Patent: Oct. 2, 2007

(54) PLANAR HEAT PIPE STRUCTURE

(76) Inventor: Hul-Chun Hsu, 6F-3, No. 422, Sec. 2, Li-Ming Rd., Taichung (TW)

( * ) Notice: Subject to any disclaimer, the term of this patent is extended or adjusted under 35 U.S.C. 154(b) by 786 days.

(21) Appl. No.: 10/858,074

(22) Filed: Jun. 2, 2004

(65) Prior Publication Data

US 2005/0269064 A1 Dec. 8, 2005

(51) Int. Cl.
*F28D 15/00* (2006.01)

(52) U.S. Cl. ..... 165/104.26; 165/104.21

(58) Field of Classification Search ..... 165/104.21, 165/104.26, 104.33, 79, 80.4; 361/687, 700; 257/715; 29/890.032; 174/15.2
See application file for complete search history.

(56) References Cited

U.S. PATENT DOCUMENTS 3,576,210 A * 4/1971 Trent ..... 165/104.26
3,789,920 A * 2/1974 Low et al. ..... 165/104.26
5,029,389 A * 7/1991 Tanzer ..... 29/890.032
6,293,333 B1 * 9/2001 Ponnappan et al. .... 165/104.26
2001/0047859 A1 * 12/2001 Ishida et al. ..... 165/104.14
2004/0069460 A1 * 4/2004 Sasaki et al. ..... 165/104.26

FOREIGN PATENT DOCUMENTS

JP 56146989 A * 11/1981
JP 2000074581 A * 3/2000

* cited by examiner

*Primary Examiner*—Tho V Duong

(57) ABSTRACT

A planar heat pipe has a hollow planar tube and a wick structure attached to an interior sidewall of the planar tube. A spiral support member is installed to extend along the interior sidewall, so as to press the wick structure against the interior sidewall. The spiral support member has a plurality of interstices extending laterally within the planar tube. A planar support member is inserted between the spiral support member in the hollow planar tube. The planar support member has a plurality of voids extending along an elongate direction of the planar tube. Thereby, cross flowing channels are formed inside of the heat pipe.

10 Claims, 4 Drawing Sheets

PLANAR HEAT PIPE STRUCTURE

BACKGROUND OF THE INVENTION

The present invention relates in general to a planar heat pipe structure, and more particularly, to a planar heat pipe structure having cross fluid channels within a planar hollow tube.

Various types of thermal conducting devices have been developed. Currently, heat pipes or heat plates (planar heat pipes) have been widely used. The heat pipe or heat plate has a tube or plate member, a wick structure attached to an interior sidewall of the tube or plate member, and a working fluid vaporized by heat absorbed from a heat source and condensed at the other end of the heat pipe or heat plate. The flow of the working fluid is assisted by the capillary force exerted by the wick structure. Thereby, heat exchange is iterated by the flow and phase change of the working fluid inside the tube or plate member.

Currently, the wick structure is fabricated from sintering powder or metal mesh. When a metal mesh is used, a support member is required to prevent the interruption of the fluid flow due to insufficient support of the metal mesh. The common support structure used in the planar heat pipe includes a plurality of grooves for guiding the fluid. These grooves are normally one or two dimensional. The one-dimensional grooves are easily made, however, provide poor guiding effect. The two-dimensional grooves, though provide better guiding of the working fluid, are difficult to fabricate.

BRIEF SUMMARY OF THE INVENTION

The present invention provides a planar heat pipe comprising a hollow planar tube and a wick structure attached to an interior sidewall of the planar tube. A spiral support member is installed to extend along the interior sidewall, so as to press the wick structure against the interior sidewall. The spiral support member has a plurality of interstices extending laterally within the planar tube. A planar support member is inserted between the spiral support member in the hollow planar tube. The planar support member has a plurality of voids extending along an elongate direction of the planar tube. Thereby, cross flowing channels are formed inside of the heat pipe. The heat pipe further comprises a working fluid in the hollow planar tube. Preferably, the interstices extend substantially perpendicularly to the voids to form cross flowing channels for the working fluid. The hollow planar tube is formed by pressing a hollow circular tube member, for example. In one embodiment, the spiral support member includes a capillary structure such as a sintering powder structure or a metal mesh structure. Similarly, the planar support member includes a capillary structure such as a sintering powder structure or a metal mesh structure.

The present invention further provides a planar heat pipe comprising an elongate hollow planar tube, a wick structure, a first support member, and a second support member. The wick structure is attached to an interior sidewall of the planar tube. The first support member extends along the interior sidewall to press the wick structure against the interior sidewall. The second support member extends along an elongate direction inside the planar tube. The first support member and the second support member form a plurality of cross fluid channels in the planar tube.

The present invention further provides a method of fabricating a hollow planar heat pipe. An elongate hollow circular tube is formed. A wick structure is attached to an interior sidewall of the circular tube. A spiral support member is installed and extending along the interior sidewall to press the wick structure against the interior sidewall. The circular tube is pressed into an elongate planar tube, so such that the spiral support member is pressed into a planar profile. A planar support member is inserted into the planar tube. The planar support member has a plurality of parallel slots extending along an elongate direction of the planar tube. The method further comprises a step of introducing a working fluid into the planar tube and a step of sealing openings of the planar tube.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
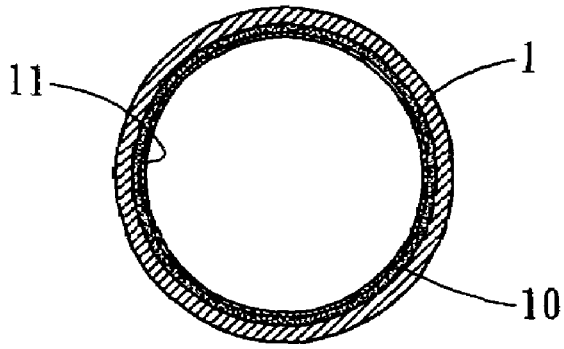
FIG. 1 depicts a lateral cross sectional view of a semi-finished heat pipe.
Figure 2:
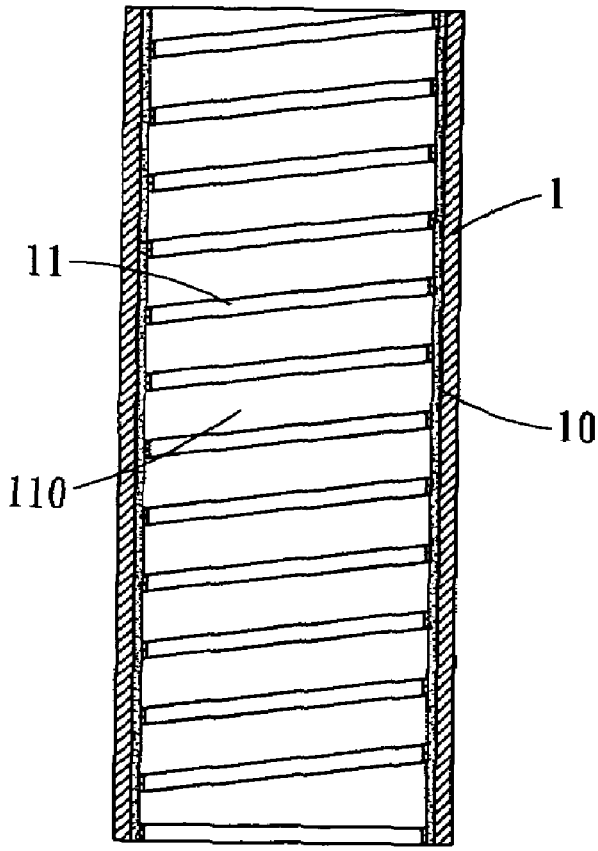
FIG. 2 depicts a cross sectional view of a longitudinal cross sectional view of a semi-finished heat pipe.
Figure 6:
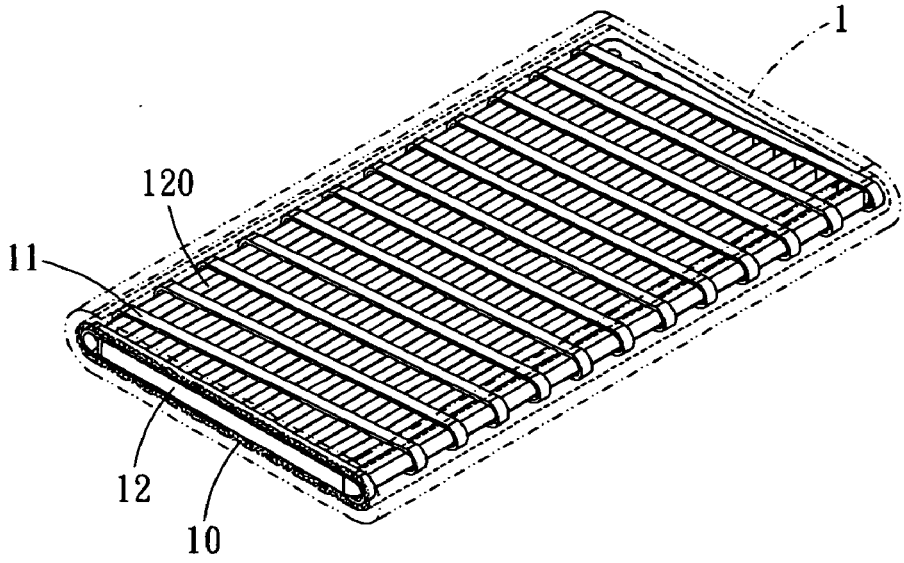
FIG. 6 shows the assembly of the semi-finished heat pipe and the planar support member.
Figure 7:
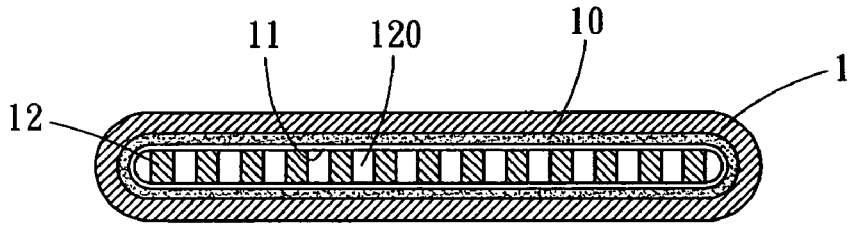
FIG. 7 shows a lateral cross sectional view of the heat pipe.
Figure 8:
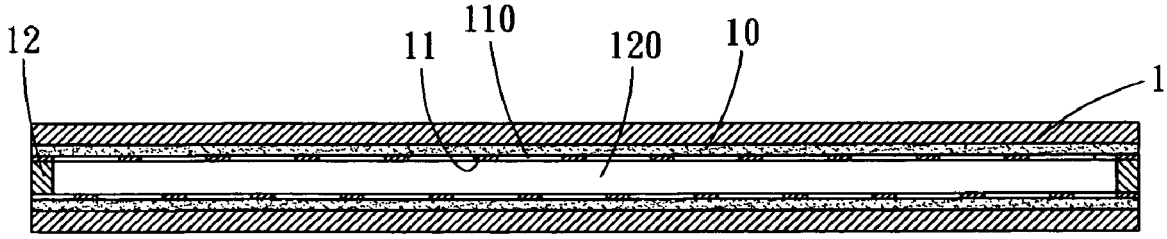
FIG. 8 shows a longitudinal cross sectional view of the heat pipe.

Referring to FIGS. 6 to 8, schematic drawing, lateral cross sectional view and longitudinal cross sectional view of a semi-finished heat pipe and a planar support member are provided. As shown, the heat pipe comprises a flat hollow plate member 1, which is fabricated by processing a circular tube member. As shown in FIGS. 1 and 2, before the steps of molding and pressing, a hollow circular tube is provided. The circular tube includes a wick structure attached to an interior sidewall thereof. The circular tube further comprises a spiral support member 11 extending along the interior sidewall of the circular tube. The spiral support member 11 presses the wick structure 10 against the interior sidewall of the circular but. As shown, as the spiral support member 11 extends, spiral interstices 110 are formed in the spiral support member 11 along the interior sidewall of the circular tube.

Figure 3:
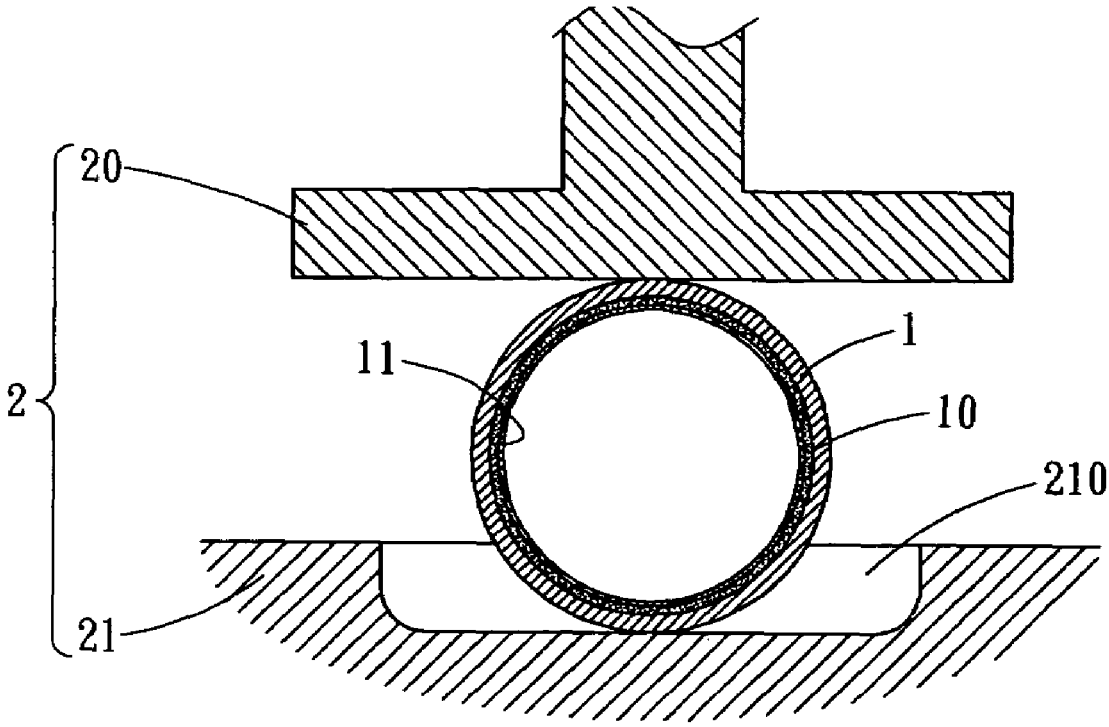
FIG. 3 illustrates the pressing process for the semi-finished heat pipe.
Figure 4:
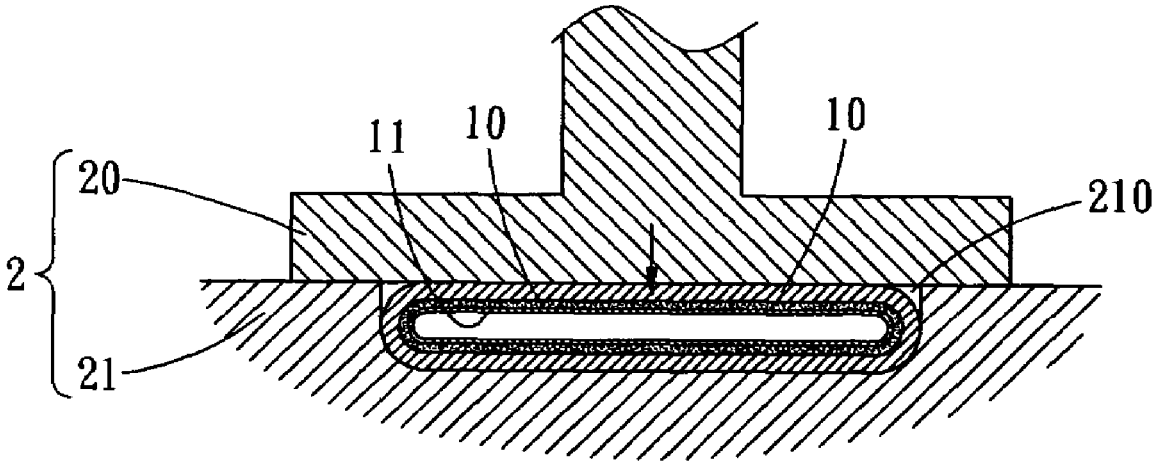
FIG. 4 illustrates the pressing process for the semi-finished heat pipe.

As shown in FIGS. 3 and 4, the circular tube comprising the wick structure 10 and the spiral support member 11 are disposed in a pressing mold 2. The pressing mold 2 includes a pressing machine 20 and a platform 21. The platform 21 has a top surface recessed to form a configuring slot 210 allowing the circular tube disposed therein. The pressing machine 20 and the configuring slot 210 both have flat surfaces, such that when the pressing machine 20 presses the circular tube against the configuring slot 210, the circular tube is pressed into a flat hollow plate 1, while the wick structure 10 and the spiral support member 11 in the hollow planar tube 1 are deformed in accordance with the configuration of the hollow planar tube 1.

Figure 5:
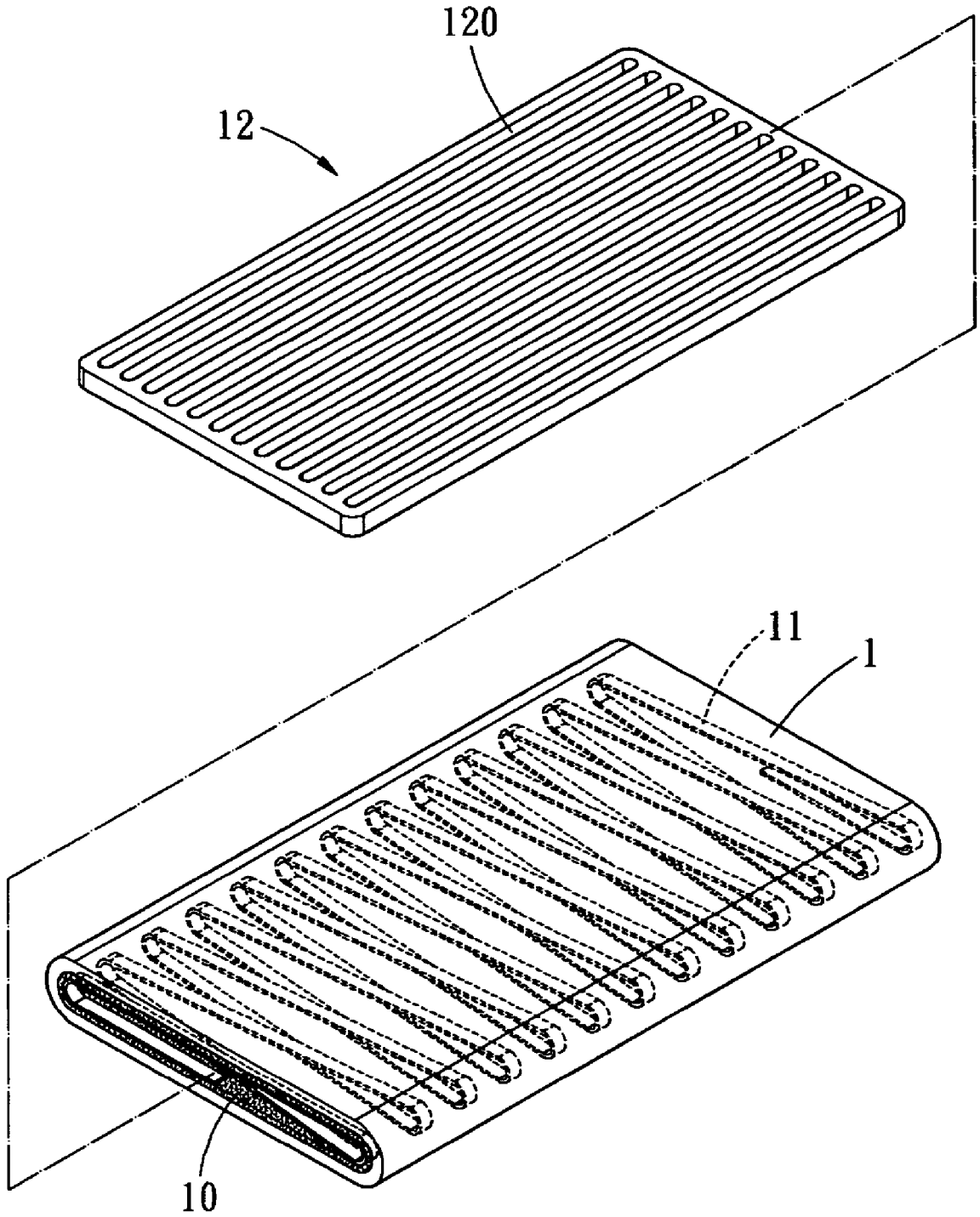
FIG. 5 shows an explode view of the semi-finished heat pipe and the planar support member.

As shown in FIGS. 5 and 6, the hollow planar tube 1 is then removed from the configuring slot 210, and a planar support member 12 is inserted inside the spiral support member 110 of the planar tube 1. The planar support member 12 has a plurality of voids 120 such as a plurality of parallel open slots extending along an elongate direction of the planar tube 1. Therefore, the voids 120 extend across the interstices 110 of the spiral support member 11 to provide cross or omni-directional flowing channels for the working fluid.

In addition, the spiral support member 11 and the planar support member 12 may also include a capillary structure formed by sintering powder or metal mesh.

Referring to FIGS. 6 to 8, as the planar heat pipe has cross flowing channels for the working fluid, such that random flow of the working fluid can be obtained during thermal conduction without any directional restriction. Therefore, the interference of the working fluid caused by the support member is minimized. The thermal conduction of the heat pipe is greatly enhanced.

The spiral support member 11 and the planar support member 12 have simple structures, such that fabrication of the planar heat pipe is simple. Further, as the planar tube 1 is obtained by pressing a circular tube, the sealing length of the opening is reduced.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A planar heat pipe, comprising:

a hollow planar tube;

a wick structure attached to an interior sidewall of the planar tube;

a spiral support member extending along the interior sidewall to press the wick structure against the interior sidewall, the spiral support member having a plurality of interstices extending laterally within the planar tube; and a planar support member inserted between the spiral support member in the hollow planar tube having a plurality of voids extending along an elongate direction of the planar tube.

2. The heat pipe of claim 1, further comprising a working fluid in the hollow planar tube.

3. The heat pipe of claim 2, wherein the interstices extend substantially perpendicularly to the voids to form cross flowing channels for the working fluid.

4. The heat pipe of claim 1, wherein the hollow planar tube is formed by pressing a hollow circular tube member.

5. The heat pipe of claim 1, wherein the spiral support member includes a capillary structure.

6. The heat pipe of claim 5, wherein the spiral support member includes a sintering powder structure or a metal mesh structure.

7. The heat pipe of claim 1, wherein the planar support member includes a capillary structure.

8. The heat pipe of claim 7, wherein the planar support member includes a sintering powder structure or a metal mesh structure.

9. The heat pipe of claim 1, wherein the wick structure includes a sintering powder structure or a metal mesh structure.

10. A planar heat pipe, comprising:

an elongate hollow planar tube;

a wick structure attached to an interior sidewall of the planar tube;

a first support member inserted into the planar tube, the first support member extending along an elongate direction of the planar tube and having a plurality of open slots therein; and a second support member winding around the first support member to press the wick structure against the interior sidewell, the second support member having a plurality of openings extending laterally across the first support member.

* * * * *